US010527240B2

(12) United States Patent
Mooar et al.

(10) Patent No.: US 10,527,240 B2
(45) Date of Patent: Jan. 7, 2020

(54) SURFACE MOUNT LUMINAIRE

(71) Applicant: LSI Industries, Inc., Cincinnati, OH (US)

(72) Inventors: Eric J. Mooar, Liberty Township, OH (US); Travis Schubert, Norfolk, VA (US); Travis Wright, Cincinnati, OH (US); Chris Papa, Cincinnati, OH (US); John D. Boyer, Lebanon, OH (US); Jonathan M. Hermansen, Maineville, OH (US)

(73) Assignee: LSI Industries, Inc., Cincinnati, OH (US)

( * ) Notice: Subject to any disclaimer, the term of this patent is extended or adjusted under 35 U.S.C. 154(b) by 0 days.

(21) Appl. No.: 16/163,851

(22) Filed: Oct. 18, 2018

(65) Prior Publication Data

US 2019/0113194 A1 Apr. 18, 2019

Related U.S. Application Data

(60) Provisional application No. 62/574,051, filed on Oct. 18, 2017.

(51) Int. Cl.
*F21S 8/04* (2006.01)
*F21V 21/02* (2006.01)
(Continued)

(52) U.S. Cl.
CPC ..... *F21S 8/04* (2013.01); *F21V 5/00* (2013.01); *F21V 15/01* (2013.01); *F21V 21/02* (2013.01);
(Continued)

(58) Field of Classification Search
CPC ..... F21S 8/04; F21V 15/01; F21V 23/009; F21V 23/001; F21V 31/005; F21Y 2103/33
See application file for complete search history.

(56) References Cited

U.S. PATENT DOCUMENTS 3,109,599 A 11/1963 Franck et al.
7,500,767 B2 3/2009 Wyatt
(Continued)

FOREIGN PATENT DOCUMENTS

CN 206093756 U 4/2017
DE 102010033297 A1 2/2012
(Continued)

OTHER PUBLICATIONS

European Patent Office, International Search Report and Written Opinion of the International Searching Authority, International Application No. PCT/US2018/056476, dated Jan. 23, 2019 (15 pages).

*Primary Examiner* — Donald L Raleigh
(74) *Attorney, Agent, or Firm* — Wood Herron & Evans LLP

(57) ABSTRACT

A luminaire is provided including a housing and at least one peripheral compartment defined in the housing that is configured to receive a lighting element. A central compartment is defined in the housing and disposed laterally inwardly of the at least one peripheral compartment. The central compartment is configured to receive control and power components for the lighting element. At least one lens is disposed over the at least one peripheral compartment such that the central compartment is accessible when the luminaire is installed on a support surface without a need to remove the at least one lens.

11 Claims, 3 Drawing Sheets

(51) Int. Cl.

| | |
|---|---|
| ***F21V 5/00*** | (2018.01) |
| ***F21V 15/01*** | (2006.01) |
| ***F21V 27/02*** | (2006.01) |
| ***F21V 23/00*** | (2015.01) |
| *F21W 131/10* | (2006.01) |
| *F21V 31/00* | (2006.01) |
| *F21Y 115/10* | (2016.01) |
| *F21Y 103/33* | (2016.01) |

(52) U.S. Cl.

CPC ..... *F21V 23/009* (2013.01); *F21V 27/02* (2013.01); *F21V 23/001* (2013.01); *F21V 31/005* (2013.01); *F21W 2131/10* (2013.01); *F21Y 2103/33* (2016.08); *F21Y 2115/10* (2016.08)

(56) References Cited

U.S. PATENT DOCUMENTS

| | | | | |
|---|---|---|---|---|
| 2002/0163801 | A1 | 11/2002 | Fischer et al. | |
| 2014/0347848 | A1* | 11/2014 | Pisavadia | F21S 8/06 362/190 |
| 2014/0376227 | A1 | 12/2014 | Schubert et al. | |
| 2015/0055353 | A1 | 2/2015 | Hutchens et al. | |
| 2016/0327240 | A1* | 11/2016 | Goujon | F21S 8/03 |
| 2017/0059142 | A1 | 3/2017 | Ye | |
| 2017/0102136 | A1* | 4/2017 | Jiang | F21V 23/003 |
| 2017/0146217 | A1 | 5/2017 | McCracken, Jr. et al. | |

FOREIGN PATENT DOCUMENTS

| | | | |
|---|---|---|---|
| EP | 2515029 | A2 | 10/2012 |
| EP | 2570718 | A1 | 3/2013 |

* cited by examiner

SURFACE MOUNT LUMINAIRE

The present application claims the filing benefit of U.S. Provisional Application Ser. No. 62/574,051, filed Oct. 18, 2017, the disclosure of which is incorporated herein by reference in its entirety.

FIELD OF THE INVENTION

The present invention relates generally to lighting fixtures and, more particularly, to a surface mount luminaire suitable for use in canopy lighting applications.

BACKGROUND OF THE INVENTION

Luminaires are used in various commercial and consumer applications to provide illumination to desired areas, such as canopies disposed over fuel pumps in service stations, storefronts, restaurants, drive-throughs, or other businesses. Such luminaires are typically mounted on or within a support structure such as a ceiling, a canopy structure, or a building exterior. Recently, lighting elements comprising light emitting diodes (LEDs) have replaced previously used lighting elements, such as high intensity discharge lamps. Regardless of the particular lighting element utilized, the construction of prior surface mount luminaires suffer various drawbacks.

For example, accessing the interior working components of conventional luminaires, particularly the drivers and other control components, is difficult and typically requires that the lighting fixture itself be removed from the mounting surface, or that the lens elements or other components be removed in order to access such working components.

Moreover, prior surface mount luminaires provide little flexibility for tuning the light emitted from the luminaire to accommodate various lighting situations.

A need therefore exits for an improved surface mount luminaire that overcomes these and other drawbacks of existing luminaires.

SUMMARY OF THE INVENTION

The present invention overcomes the foregoing and other shortcomings and drawbacks of lighting fixtures heretofore known for use in various commercial and other lighting applications. While the present invention will be described in connection with certain embodiments, it will be understood that the present invention is not limited to these embodiments. On the contrary, the present invention includes all alternatives, modifications and equivalents as may be included within the spirit and scope of the present invention.

In one embodiment of the present invention, a surface mount luminaire is provided for use in canopy lighting applications. The luminaire includes a housing which supports various components of the luminaire and provides a convenient platform for securing the luminaire to a suitable support surface, such as a ceiling of a canopy structure or other surface.

At least one peripheral compartment is defined in the housing that is configured to receive at least one lighting element, such as at least one light emitting diode (LED), for example.

A central compartment is defined in the housing that is disposed laterally inwardly of the at least one peripheral compartment. The central compartment is configured to receive control and power components for powering and controlling the lighting elements disposed in the respective peripheral compartments.

The luminaire further comprises at least one lens that is disposed over the at least one peripheral compartment. Light emitted from the respective lighting elements passes through the at least one lens and is directed outwardly from the luminaire in a desired pattern or fashion. In one embodiment, each peripheral compartment is provided with a respective lens. Alternatively, the luminaire may include only a single, annular-shaped peripheral compartment that is configured to receive one or more lighting elements and a single lens having a generally annular configuration such that the lens is disposed over the one or more lighting elements received in the single peripheral compartment.

In one embodiment, a removable panel is configured to be secured to the housing for covering the central compartment and the control and power components received in the central compartment.

In accordance with the principles of the present invention, the central compartment is accessible when the luminaire is installed on the support surface without a need to remove a lens so as to facilitate access to the control and power components of the luminaire.

The above and other objectives and advantages of the present invention shall be made apparent from the accompanying drawings and the description thereof.

BRIEF DESCRIPTION OF THE DRAWINGS

The accompanying drawings, which are incorporated in and constitute a part of this specification, illustrate an embodiment of the invention and, together with a general description of the invention given above, and the detailed description of the embodiments given below, serve to explain the principles of the invention.

DETAILED DESCRIPTION

Figure 1:
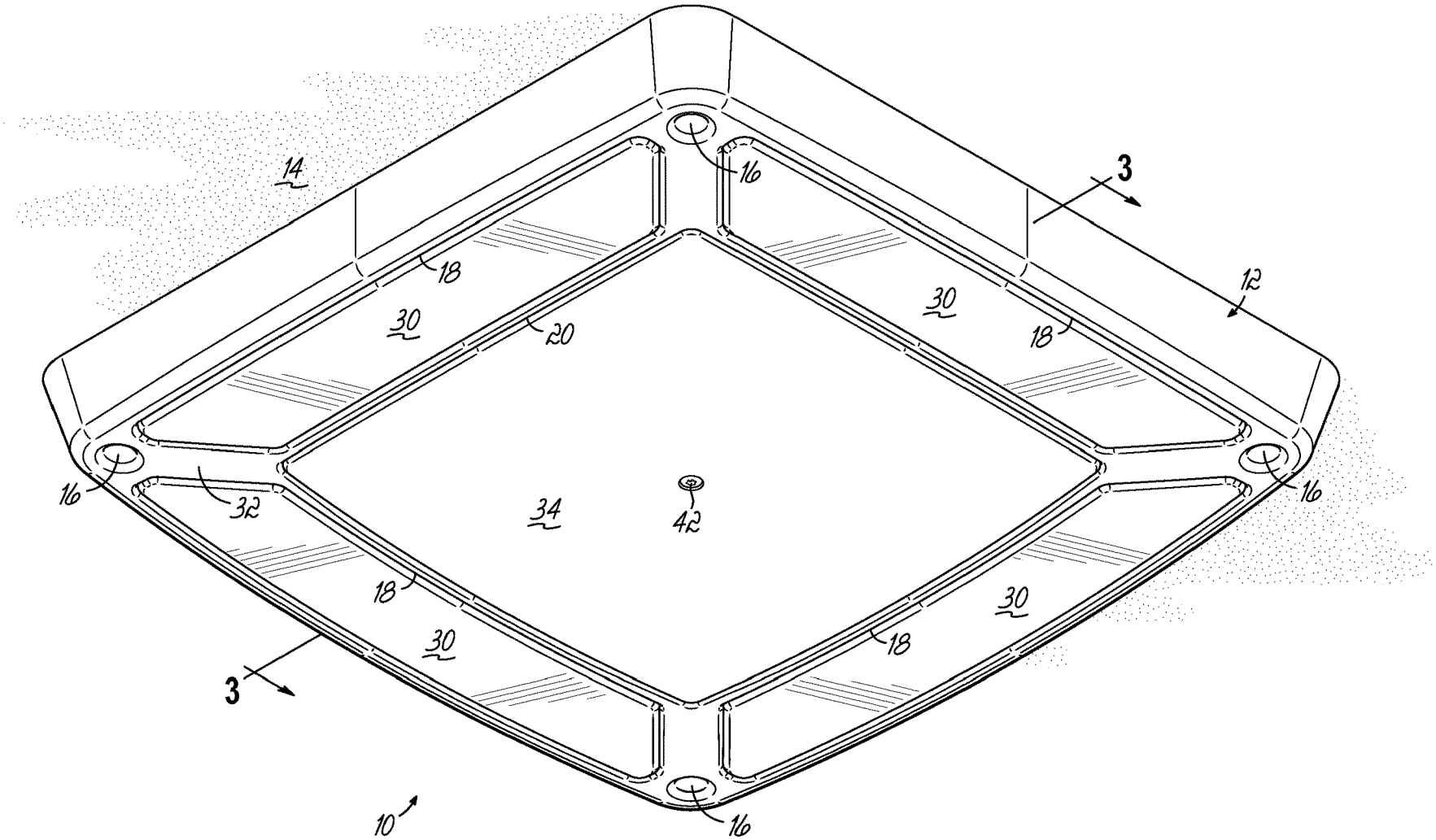
FIG. 1 is a perspective view of an exemplary surface mount luminaire in accordance with the principles of the present disclosure.

FIG. 1 depicts an exemplary surface mount luminaire 10 suitable for use in canopy lighting applications in accordance with the principles of the present invention. The luminaire 10 may include structural features similar to those shown and described in U.S. Patent Application Publication No. 2014/0376227 and U.S. Patent Application Publication No. 2015/0055353, the disclosures of which are incorporated by reference herein in their entirety. Accordingly, the following description focuses on additional features, or on features of the inventive surface mount luminaire which are different from those shown and described in these applications.

In the embodiment shown, the luminaire 10 comprises a housing 12 which supports the components of the luminaire 10 and provides a convenient platform for securing the luminaire to a suitable support surface 14, such as a ceiling of a canopy structure or other surface. In the embodiment shown, a plurality of apertures 16 are provided proximate the periphery of the housing 12 and which are configured for receiving screws, bolts, or other suitable fasteners securing the housing 12 to the support surface 14. The housing 12 further includes at least one peripheral compartment 18 configured to receive a lighting element 24 therein. In the embodiment shown, the housing 12 has a generally square shape and includes four peripheral compartments 18, each disposed along a respective side edge of the housing 12.

Figure 3:
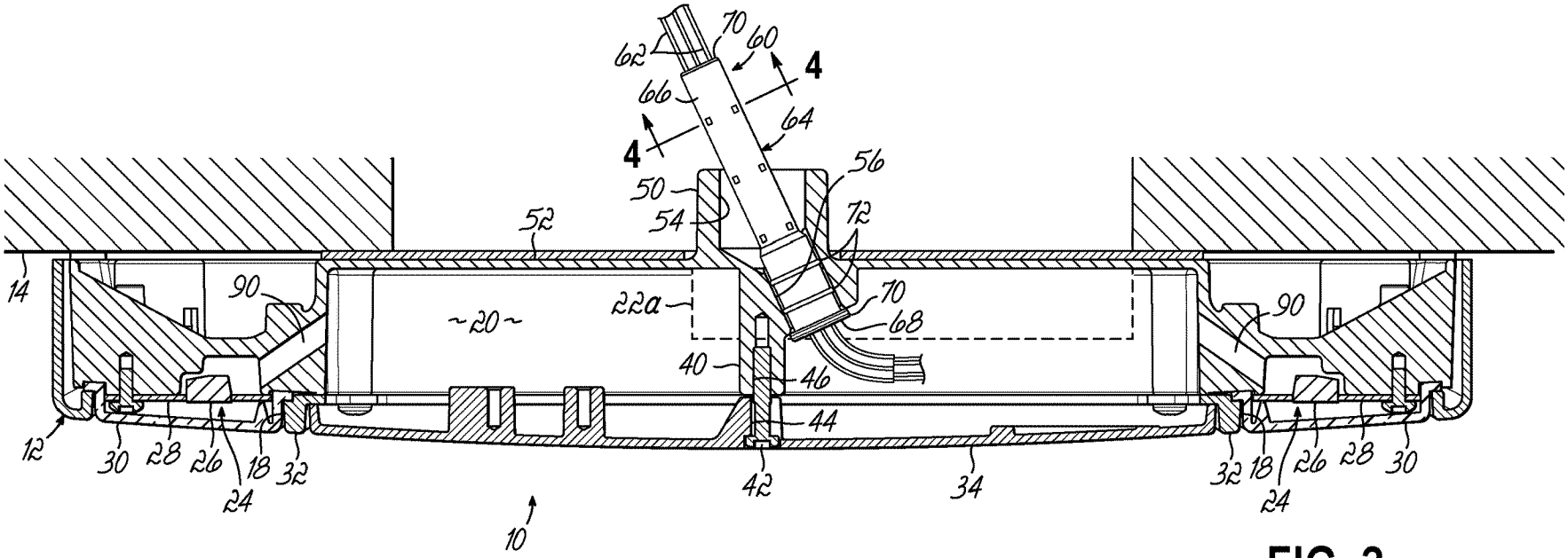
FIG. 3 is a cross-sectional view of the luminaire of FIG. 1 taken along line 3-3.

The housing 12 further includes a central compartment 20 disposed laterally inwardly of the peripheral compartments 18 and configured to receive control or power components 22*a*, 22*b*, 22*c* for powering and controlling lighting elements 24 disposed in the respective peripheral compartments 18. In the embodiment shown, the lighting elements 24 comprise a plurality of light emitting diodes 26 (LEDs) supported on respective circuit boards 28, such as printed circuit boards (FIG. 3). It will be appreciated, however, that various other lighting elements may alternatively be used with the inventive luminaire.

Figure 2:
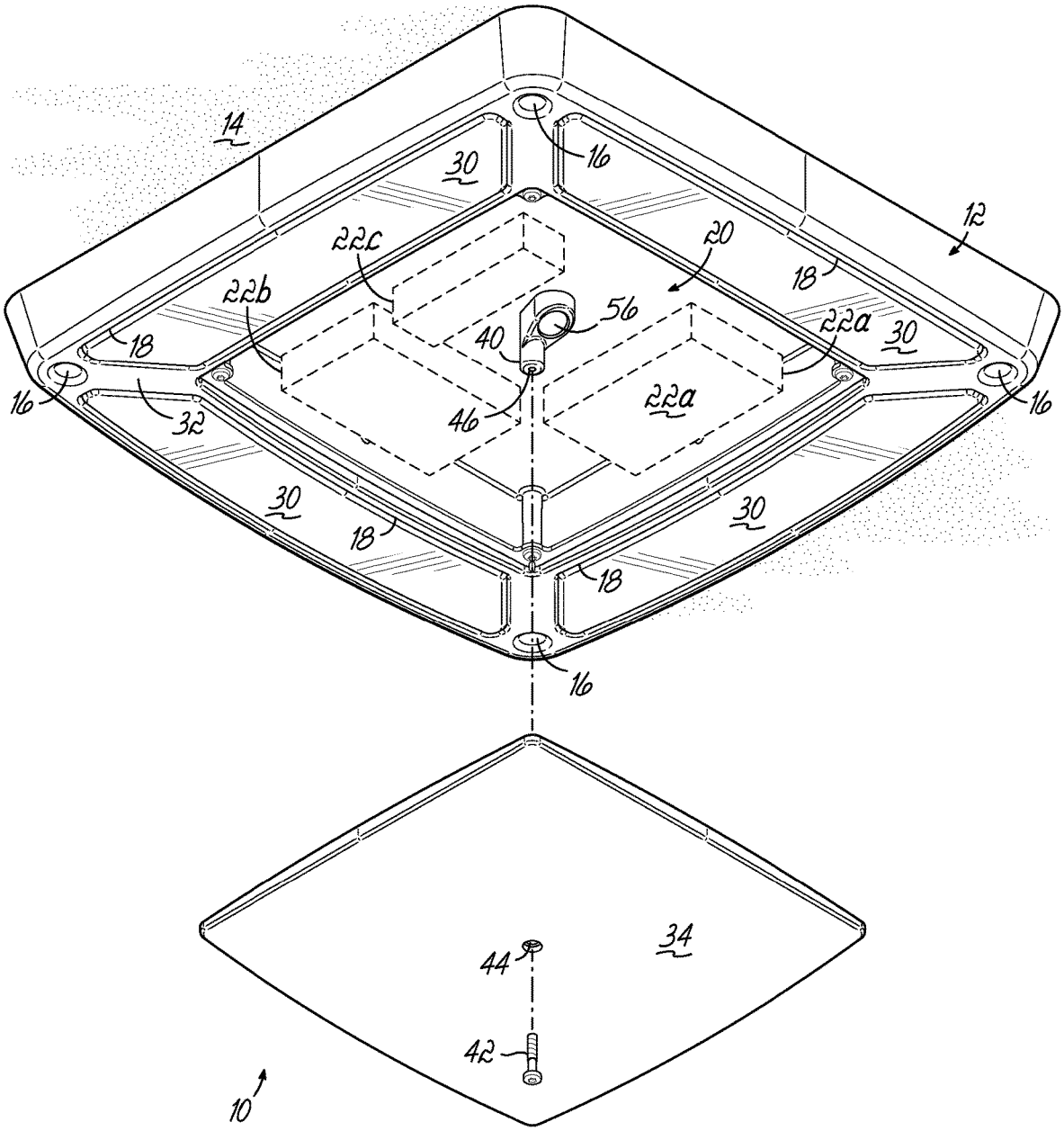
FIG. 2 is an exploded perspective view of the luminaire of FIG. 1.

As shown in FIGS. 1-3, the luminaire 10 further includes individual lens elements 30 configured to be received adjacent openings of the respective peripheral compartments 18, whereby light emitted from the respective lighting elements 24 passes through the lens elements 30 and is directed outwardly from the luminaire 10 in a desired fashion. While the exemplary housing 12 of the embodiment shown and described herein includes four peripheral compartments 18, each provided with its own lighting element 24 and a respective lens element 30, it will be appreciated that various other configurations may alternatively be used. For example, another exemplary luminaire may comprise 2, 3, or more peripheral compartments arranged around a central compartment. In another embodiment, an exemplary luminaire may include only a single, annular-shaped peripheral compartment configured to receive one or more lighting elements and which do not obstruct access to the central compartment which receives and supports the power and control components of the luminaire as described above.

Similarly, an exemplary luminaire may comprise a single lens element having a generally annular configuration such that the lens element is disposed over the one or more lighting elements received in the one or more peripheral compartments without obstructing access to the central compartment. Even if a single lens element is used with the luminaire housing, tuning of the light output from the luminaire is possible by configuring the lens element to have different properties on different portions of the lens element such that light emitted from the one or more lighting elements may be varied as desired. The one or more lens elements 30 may be secured to the housing 12 in any suitable manner. In the embodiments shown, the luminaire 10 further comprises a lens frame 32 that may be coupled with the housing 12 to support the lens elements 30 adjacent the respective peripheral compartments 18 on the housing 12.

The light output from the luminaire 10 can additionally or alternatively be varied by selective configuration of the lighting elements 24 disposed in the peripheral compartments 18. For example, the LEDs 26 provided on the respective circuit boards 28 disposed in the peripheral compartments 18 may be configured and arranged to provide symmetrical or asymmetrical light distribution, and LEDs 26 may be selected to provide desired brightness and color temperature characteristics to achieve a desired output.

The luminaire 10 may further comprise a removable panel 34 configured to be received adjacent the opening of the central compartment for enclosing the power and control components 22*a*, 22*b*, 22*c* therein. In the embodiment shown, the housing 12 includes a generally downwardly extending projection 40 disposed within the central compartment 20 (FIGS. 2 and 3). The panel 34 may be removably secured adjacent the opening of the central compartment 20 by a screw, bolt, or other suitable fastener 42 received through an aperture 44 in the panel 34 and engaging a corresponding aperture 46 in the projection 40.

The housing 12 further includes a boss 50 (FIG. 3) disposed on a back portion 52 of the housing 12, generally opposite the central compartment 20. An aperture 54 on the boss 50 leads to a passage 56 communicating with the central compartment 20. The luminaire 10 further includes a wiring harness 60 (FIGS. 3 and 4) extending between the central compartment 20 and the environment external of the housing 12. In the embodiment shown, the wiring harness 60 comprises one or more wires 62 to which a resilient sealing member 64 is over-molded along a lengthwise portion of the wires 62. The resilient member 64 may comprise polyvinylchloride or any other material suitable to be over-molded along a portion of the length of the wires 62 and which can provide sealing engagement with the housing 12. Because the resilient member 64 is over-molded directly onto the wires 62, the wiring harness 60 is self-sealing against the housing 12 without requiring additional sealing elements, adhesive, or other materials to create a watertight seal between the wiring harness 60 and the housing 12.

In the embodiment shown, the resilient sealing member 64 defines a generally elongate seal body 66 having first and second oppositely disposed free ends 68, 70 and an outer circumferential surface. The first free end 68 is configured to extend through the passage 56 in the housing 12 for communication with the central compartment 20. To facilitate sealing engagement of the resilient member 64 with the housing 12, the first free end 68 may include one or more raised circumferential ridges 72 extending outwardly from the outer surface and which create sealing contact with portions of the wall of the passage 56 communicating with the central compartment. The resilient sealing member 64 may further include a radially outwardly extending flange 74 disposed adjacent the first end 68 and facilitating sealing engagement with the distal end of the passage 56.

Figure 4:
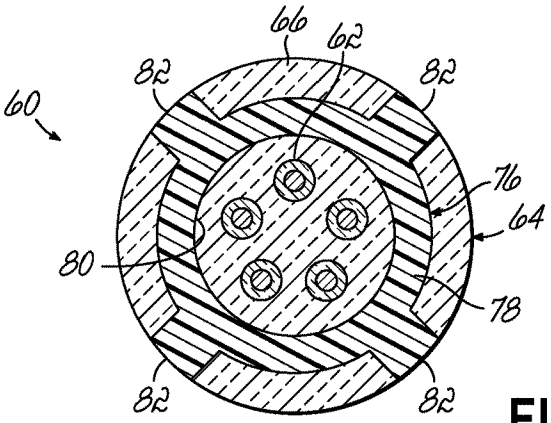
FIG. 4 is a cross-sectional view of an exemplary wiring harness depicted in FIG. 3 and taken along line 4-4.

The wiring harness 60 may further include one or more spacing members 76 encapsulated within the over-molded resilient member 64. The spacing members 76 are configured to locate and support the one or more wires 62 in a mold cavity prior to being over-molded with the material forming the resilient member 64. In the embodiment shown, the spacing members 76 comprise a generally annular body 78 having a central passage 80 for receiving wires 62 of the wiring harness 60 therethrough (FIG. 4). The spacing member 76 further includes a plurality of radially outwardly extending projections 82 configured to engage the mold cavity and thereby space the wires 62 from the walls of the mold cavity for proper positioning prior to injection of the over-molded material.

The housing 12 may further include one or more passages 90 extending between the central compartment 20 and the one or more peripheral compartments 18 thereby providing communication therebetween. Additional wiring may be routed through the one or more passages 90 to facilitate providing power and/or control signals to the lighting elements 24 disposed within the respective peripheral compartments 18.

A surface mount luminaire in accordance with the principles of the present invention facilitates access to the power and control components of the luminaire without the need to remove lens elements or other components of the luminaire as discussed above. Moreover, the inventive luminaire facilitates selective tuning and configuration of the light output from the luminaire as may be desired.

While the present invention has been illustrated by the description of a specific embodiments thereof, and while the embodiment has been described in considerable detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details shown and described. Accordingly, departures may be made from such details without departing from the scope of the general inventive concept.

What is claimed is:

1. A luminaire, comprising:

a housing adapted for installation to a support surface;

at least one peripheral compartment defined in the housing and configured to receive a lighting element;

a central compartment defined in the housing and disposed laterally inwardly of the at least one peripheral compartment, the central compartment being configured to receive control or power components for the lighting element;

at least one lens disposed over the at least one peripheral compartment;

a wiring harness extending between the central compartment and externally of the housing, the wiring harness comprising:

at least one wire; and a resilient sealing member over-molded onto a lengthwise portion of the at least one wire, wherein the resilient sealing member of the wiring harness defines a generally elongate seal body having first and second oppositely disposed free ends and an outer surface, the first free end extending through a passage in the housing providing communication with the central compartment, the opposite second free end extending externally of the housing, and the outer surface sealingly engaging the passage, and wherein the central compartment is accessible when the luminaire is installed on the support surface without a need to remove the at least one lens.

2. The luminaire of claim 1, wherein at least one of the lighting element or the at least one lens is configured to vary light characteristics emanating from different portions of the luminaire.

3. The luminaire of claim 2, wherein the at least one lens comprises a single lens structure having at least two lens portions configured to produce different light characteristics with light passing through the respective lens portions from the lighting element disposed adjacent the respective lens portions.

4. The luminaire of claim 1, wherein the at least one peripheral compartment comprises at least two peripheral compartments, each supporting a separate lighting element.

5. The luminaire of claim 4, wherein the at least one lens comprises at least two lenses, wherein each lens is disposed over a respective one of the at least two peripheral compartments.

6. The luminaire of claim 1, further comprising at least two lighting elements and at least two peripheral compartments defined in the housing, wherein each lighting element is disposed in a respective one of the at least two peripheral compartments.

7. The luminaire of claim 1, wherein the lighting element comprises a light emitting diode (LED).

8. The luminaire of claim 1, wherein the resilient sealing member comprises at least one raised circumferential ridge extending outwardly from the outer surface and disposed adjacent the first end.

9. The luminaire of claim 8, wherein the resilient sealing member further comprises a radially outwardly extending flange disposed adjacent the first end.

10. The luminaire of claim 8, wherein the wiring harness further comprises at least one spacing member encapsulated within the over-molded resilient member, the spacing member being configured to locate and support the at least one wire prior to over-molding of the resilient member.

11. The luminaire of claim 1, further comprising a removable panel configured to be secured to the housing for covering the central compartment.

* * * * *